United States Patent [19]

Thomas, III

[11] Patent Number: 4,666,195

[45] Date of Patent: May 19, 1987

[54] DOOR SECURITY APPARATUS

[76] Inventor: James A. Thomas, III, 728 R W. 1st Pl., Mesa, Ariz. 85201

[21] Appl. No.: 781,349

[22] Filed: Sep. 30, 1985

Related U.S. Application Data

[63] Continuation-in-part of Ser. No. 733,040, May 13, 1985, abandoned.

[51] Int. Cl.[4] ..... E05C 3/10

[52] U.S. Cl. ..... 292/338; 292/DIG. 15; 292/336.3

[58] Field of Search ..... 292/DIG. 15, DIG. 19, 292/342, 343, 338, 339, 288–298, 258, 259, 262, 272, 217, 336.3; 254/39; 70/94

[56] References Cited

U.S. PATENT DOCUMENTS

| | | | |
|---|---|---|---|
| 168,563 | 10/1875 | Fellows et al. | 292/272 |
| 867,811 | 10/1907 | Edgcomb | 292/DIG. 15 X |
| 957,584 | 5/1910 | Vanoni | 292/DIG. 15 X |
| 1,054,151 | 2/1913 | Troetel | 70/94 X |
| 1,661,240 | 3/1928 | Trimbach | 292/DIG. 15 X |
| 3,771,376 | 11/1973 | Larkin | 292/217 X |
| 4,456,291 | 6/1984 | Brogie | 292/DIG. 15 X |
| 4,494,784 | 1/1985 | Haynes | 292/338 X |

FOREIGN PATENT DOCUMENTS

| | | | |
|---|---|---|---|
| 107321 | 4/1899 | Fed. Rep. of Germany | 292/338 |
| 726162 | 10/1942 | Fed. Rep. of Germany | 292/338 |

*Primary Examiner*—Richard E. Moore
*Attorney, Agent, or Firm*—William W. Holloway

[57] ABSTRACT

A door security apparatus for preventing unauthorized opening of a door includes a rockshaft journalled for pivot movement at the bottom edge of the door and having at least one stop arm extending therefrom. An operating device is connected to the rockshaft for pivoting the rockshaft to move the stop arm into and out of door bracing engagement with the floor proximate the door.

4 Claims, 4 Drawing Figures

DOOR SECURITY APPARATUS

CROSS REFERENCE TO RELATED APPLICATION

This Application is a Continuation-in-Part of a co-pending U.S. patent application entitled DOOR BRACE, Ser. No. 733,040, now abandoned, filed on May 13, 1985, by the same inventor.

BACKGROUND OF THE INVENTION

1. Field of the Invention

This invention relates in general to security devices and more particularly to a bracing device for use on the interior surface of a door to prevent unauthorized opening therof.

2. Description of the Prior Art

The most commonly used and most effective door security device is the dead bolt lock for preventing unauthorized entry through the door of a residence. However, skilled burglars can, and often do gain entry.

Briefly, there are two types of dead bolt locks, namely those which are operated manually on the interior side of the door and those which must be operated with a key on both sides of a door. The latter of these types of dead bolts is recommended for maximum security and when a door is provided with the recommended type of dead bolt, there is no visual indication that the lock has been set. This, in addition to forgetfulness, often results in dead bolt locks being left unset.

Further, the installation work required to retrofit an existing door with a dead bolt lock is beyond the skills of many people. And, many residential occupants are unable, or unwilling, to pay someone else to make the installation.

Another type of door security device in relatively common usage is a chain device in which one end of the chain is fixed to a bracket carried on the door and is selectively connectable to another bracket that is mounted on the door jamb. This type of security device allows a door to be opened a few inches before the chain is moved into a taut position wherein it is intended to prevent further opening of the door. However, once the door is opened those few inches, which is relatively easy for an experienced burglar to accomplish, the chain can be easily cut. Also, once opened those few inches, the door can be opened the rest of the way by a burglar forcefully pushing on the door so that one or the other, or both, of the mounting brackets will be pulled loose from their mounted positions.

Therefore, a need exists for a new and useful door security apparatus which overcomes some of the drawbacks and shortcommings of the prior art door security devices.

SUMMARY OF THE INVENTION

In accordance with the present invention, a new and useful door security apparatus is disclosed for use in providing security against unauthorized opening of a door. The door security apparatus includes a door brace having rockshaft with at least one stop arm extending therefrom with the extending end of the stop arm preferably having a friction foot thereon. The rockshaft is pivotably journalled for rotation about its longitudinal axis in a spaced apart pair of pillow block brackets which are screwed or otherwise attached to the interior surface of the door in a position wherein the rockshaft is proximate and parallel with respect to the lower edge of the door. Pivot movement of the rockshaft allows the stop arm to be moved between an active, or set, position wherein the stop arm extends angularly downwardly from the rockshaft, and thus the door, into engagement with the floor in the vicinity of the door to positively brace the door against unauthorized opening, and an inactive, or unset, position wherein the stop arm is out of engagement with the floor so that the door may be opened.

The door security apparatus of the present invention further includes an operating means by which the rockshaft of the door brace may be pivotably moved to move the stop arm between its active and inactive positions, and for lockingly holding the rockshaft and the stop arm in the inactive position. The operating means is preferably configured to allow remote operation, e.g. operation may be accomplished without requiring that the user kneel or stoop down to reach the door brace of the security apparatus. To accomplish the preferred remote operation, a lever is mounted on one end of the rockshaft and a pull rod is pivotable and loosely connected to the extending end of the lever. The pull rod extends upwardly from the lever and is supported in the upstanding position by a bracket means which, in addition to its supporting function, allows the pull rod to be moved up and down to produce the needed pivot movement of the rockshaft and allows the pull rod to be latchingly held in the up position wherein the stop arm is in its inactive position.

Accordingly, it is an object of the present invention to provide a new and useful door security apparatus which positively and reliably prevents unauthorized opening of a door.

Another object of the present invention is to provide a new and useful door security apparatus which is easy to install and simple to use and provides a highly visible indication of its position to allow the occupant to readily ascertain whether the apparatus is in the active or inactive position.

Another object of the present invention is to provide a new and useful door security apparatus which includes a door brace device having a rockshaft which is journalled for pivot movement proximate the lower edge of a door and has at least one stop arm extending therefrom for movement between an active position wherein the stop arm is in door bracing engagement with the floor in the vicinity of the door, and an inactive position wherein the stop arm is out of engagement with the floor to allow the door to be opened.

Still another object of the present invention is to provide a door security apparatus of the above described character and further including an operating means attached to the rockshaft of the door brace device for pivotably moving the rockshaft, and moving the stop arm between its active and inactive positions.

Yet another object of the present invention is to provide a door security apparatus of the above described character wherein the operating means extends upwardly from the rockshaft of the door bracing device to proximate the door knob of the door to allow remote operation of the door brace device.

The foregoing and other objects of the present invention as well as the invention itself, may be more fully understood from the following description when read in conjunction with the accompanying drawings.

DESCRIPTION OF THE PREFERRED EMBODIMENT

Figure 1:
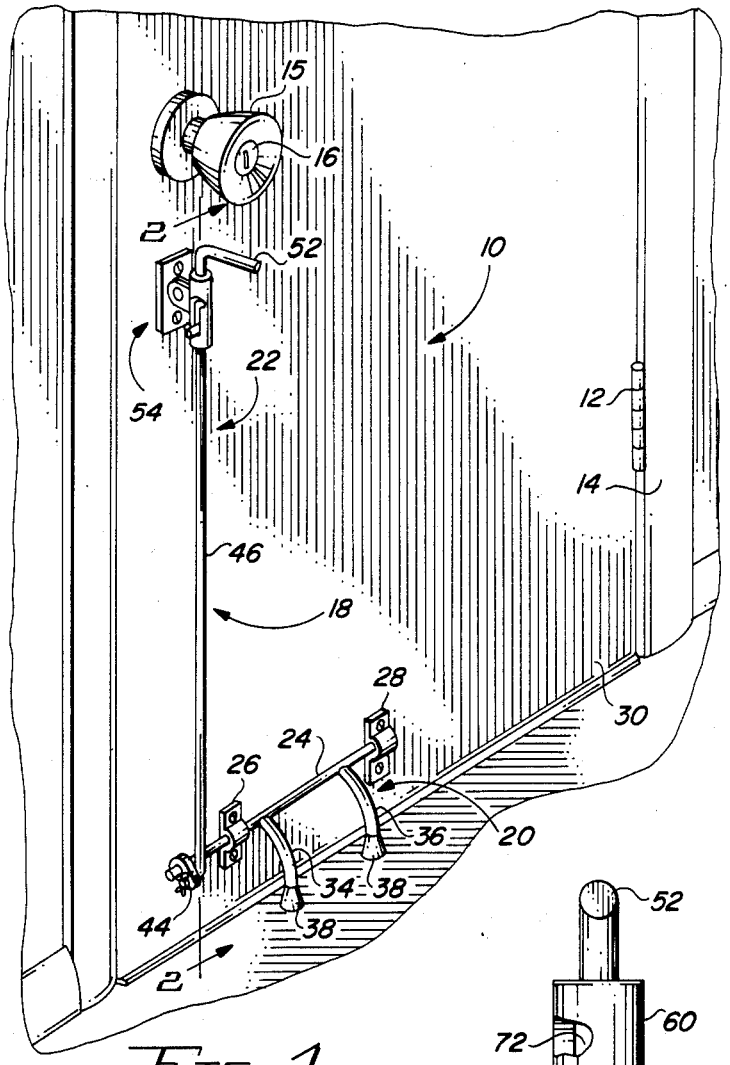
FIG. 1 is a fragmentary perspective view of the interior surface of a typical residential door having the door security apparatus of the present invention mounted thereon.

Referring more particularly to the drawings, FIG. 1 shows a typical inwardly opening residential type door 10 which is hingedly mounted by suitable butt hinges 12 (one shown) in a door frame, or jamb, 14. The door 10 is provided with the usual knob 15 for manual manipulation of a latching mechanism (not shown), which, as is customary, is normally equipped with a locking device that is operated by a key from the outside and a thumb latch 16, or functional equivalent, from the inside.

As will hereinafter be described in detail, the door 10 is equipped with the door security apparatus of the present invention which is indicated in its entirety by the reference numeral 18. And, the door security apparatus 18 includes the major components, or assemblies, of a door brace device 20 and an operating means 22.

The door brace device 20 includes a rockshaft 24 which defines longitudinal axis 25 and is journalled for rotation about its longitudinal axis in a mounting means which is preferably in the form of the illustrated pillow block brackets 26 and 28. The brackets 26 and 28 are screwed as at 29, or otherwise attached to the inwardly facing surface 30 of the door 10 and are provided with suitable bushings (not shown) in which the rockshaft 24 is journalled. The brackets 26 and 28 are located proximate the lower edge 31 of the door 10 and are disposed so that the rockshaft 24 is substantially parallel with the lower edge 31 of the door and is spaced therefrom as seen best in FIG. 2.

At least one, and preferably the two illustrated, or more, stop arms 34 and 36 extend from the rockshaft 24 at spaced apart locations along the length thereof and the stop arms 34 and 36 extend in planes which are generally normal with respect to the longitudinal axis of the rockshaft 24. Each of the stop arms 34 and 36 has a friction foot means 38 on its extending end. The friction foot means 38 are formed of rubber or other similar material which will resist skidding along the surface of the floor 40 adjacent the door 10 for reasons which will become apparent as this description progresses.

The stop arms 34 and 36 are formed integral with the rockshaft 24 such as by being cast integrally therewith, welded or the like, and are therefore movable with the rockshaft.

Figure 2:
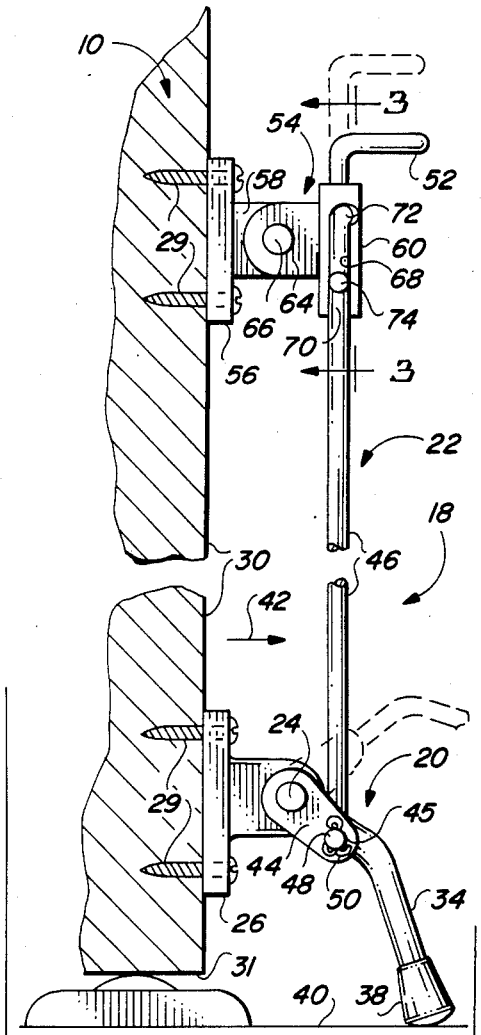
FIG. 2 is an enlarged fragmentary sectional view taken generally along the line 2—2 of FIG. 1

The rockshaft 24, and thus the stop arms 34 and 36, are pivotably movable between an active, or set, position shown in solid lines in FIG. 2, and an inactive, or unset, position shown is dashed lines in that same figure.

When the door brace device 20 is in the above mentioned active position, the stop arms 34 and 36 extend angularly and downwardly from the rockshaft into engagement with floor 40 and thereby brace the door against unauthorized opening. As can be appreciated by reference to FIG. 2, any forces applied in the direction of arrow 42, tending to open the door 10, will cause the arms 34 and 36 to be forced more tightly against the surface of the floor 40 in what may be described as a wedging action between the floor 40 and the door 10. Increasing the forces applied against the door in the direction of the arrow 42 will result in increasing the wedging action and thereby providing increased resistance to unauthorized opening of the door 10.

The operating means 22 may be configured in any suitable manner which facilitates accomplishment of the above described pivotable movement of the door brace device 20 and will latchingly hold the device in its inactive position. The operating means 22 is preferably configured as will hereinafter be described in detail so that the door brace device 20 can be operated from a remote, or elevated, position so as to eliminate the need of a user kneeling or stooping down to reach the device.

To accomplish the above stated objectives, a lever 44 is affixed transversely on one end of the rockshaft 24 and an aperture 45 is formed through the extending end of the lever. A pull rod 46 has its lower end bent as at 47 to provide a lug 48 which passes loosely through the aperture 45 of the lever 44 and is secured therein against axial displacement such as by means of the illustrated cotter pin 50. The pull rod 46 extends upwardly from the lever 44 so as to position a handle means 52, which is provided on its uppermost end, in the vicinity of the knob 15 of the door 10.

The pull rod 46 of the operating means 22 is supported in its upstanding position by a bracket means 54 which, in addition to its supporting function, provides means for latching the door brace device 20 in its inactive position. The bracket means 54 includes a base 56 which is screwed or otherwise attached to the inner surface 30 of the door 10 below the knob 15, and the base includes a normally extending ear 58. The bracket means 54 further includes a tubular bearing member 60 defining a bore 62 and having an ear 64 extending laterally therefrom. The ear 64 of the tubular bearing member 60 is attached by means of a pivot pin 66 to the ear 58 of the base 56 so that the bore 62 of the bearing member 60 will lie in a substantially vertical attitude and is free to pivotably deviate from that attitude.

The pull rod 46 extends loosely through the bore 62 of the bearing member 60 so as to be axially and rotatably movable therein. When the pull rod 46 is in the downwardly disposed position, as indicated in solid lines in FIG. 2, the door brace device 20 is in the active, or set, position. When the pull rod 46 is pulled upwardly to the position shown in dotted lines, the lever 44, and therefore the rockshaft 24 and the stop arms 34 and 36 will be pivotably moved about the longitudinal axis of the rockshaft 24 into the inactive position of the door brace device 20.

When the lever 44 is pivotably moved in the above described manner, its aperture 45 will follow an arcuate path about the axis of the rockshaft. Since the lug 48 of the pull rod 46 is carried in the aperture 45 of the lever 44, the lug 48 will generally follow the same arcuate path. Therefore, the pullrod 46 will deviate from its vertical attitude during its movements between upwardly and downwardly disposed positions thereof. In that the bearing member 60 is pivotably connected to the base 56 of the bracket means 54, as hereinbefore described, it will also be free to follow the deviations from the vertical attitude of the pull rod 46.

As hereinbefore mentioned, the pull rod 46 is a loose fit in the bore 62 of the bearing member 60 and if that fit is loose enough, the pivot action of the bearing member 60 will be unnecessary.

Figure 3:
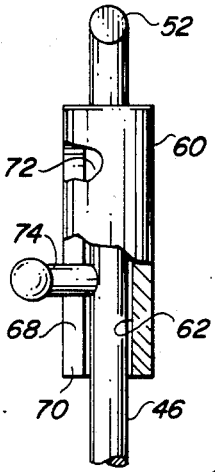
FIG. 3 is an enlarged fragmentary sectional view taken along the line 3—3 of FIG. 2
Figure 4:
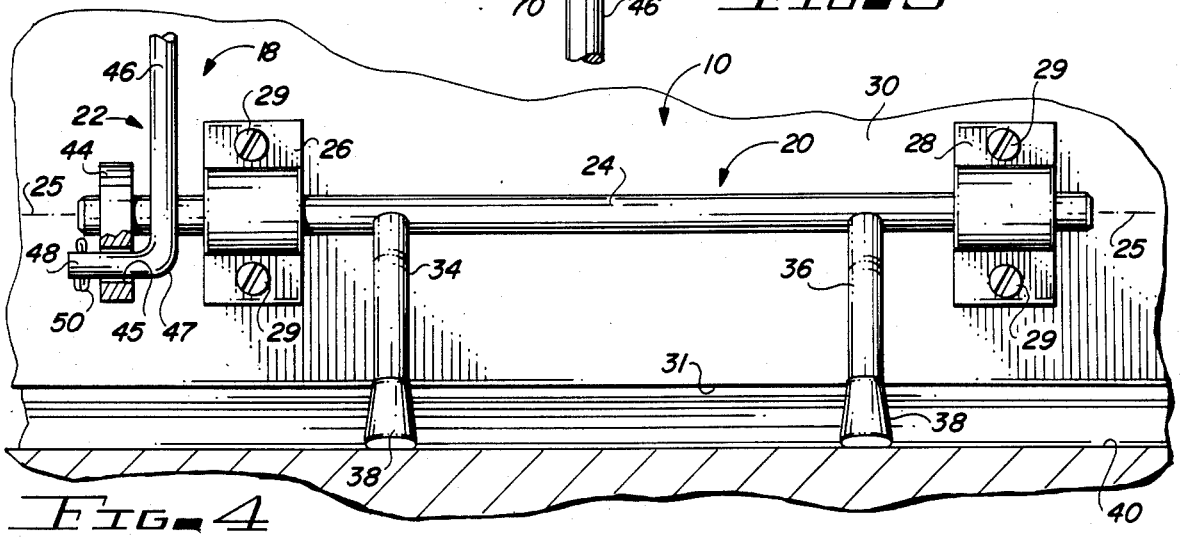
FIG. 4 is an enlarged fragmentary elevational view of the rockshaft and stop arm assembly of the door brace device.

As shown in FIGS. 2 and 3, the tubular bearing member 60 is provided with a longitudinally extending slot 68 formed in its sidewall and that slot is open as at 70 on its lower end. The upper end of the slot 68 is closed, e.g. it does not extend the entire length of the bearing member 60, but instead opens laterally into a blind latching slot 72 which extends at a right angle from the closed upper end of the longitudinal slot 68. The pull rod 46 is provided with a laterally extending arm 74 which moves up and down in the longitudinal slot 68 defined by the bearing member 60 in accompaniment with the up and down movements of the pull rod.

When the pull rod 46 is pulled to its up position, it can be rotated by the user so that the arm 74 moves into the latching slot 72 so that the pull rod 46 will be latchingly held in its up position. And, this will hold the door brace device 20 in the inactive position thereof. Rotating movement of the pull rod 46 is possible due to the loose fit of the lug 48 in the aperture 45 of the lever 44 as hereinbefore described.

It will be apparent from the above that the door security apparatus of the present invention need not be latched in its active, or set, position. The door security device 10 is automatically biased and held in the active position by the weight of the stop arms 34 and 36 and the pull rod 46.

The door security apparatus 10 provides several advantages over the thereinbefore discused prior art door security devices. First among these advantages is the highly visible appearance of the device which allows the occupant to readily ascertain the set or unset position of the security apparatus. Secondly, when unauthorized opening of the door 10 is attempted, the apparatus 10 will increase its resistance to the unauthorized opening. All prior door security devices known to me will, on the other hand, remain passive and will at some point yield to the opening forces applied to the door. For example, a dead bolt will tear its socket member out of the door jamb if enough force is applied to the door. And, a chain type will rip one or the other of its mounting brackets away from either the door or the door jamb.

In addition to the above advantages, the door security apparatus 10 is simple to install and such installation is within the skill of most people.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A door security apparatus for attachment to the inwardly facing surface of an inwardly opening door for bracing the door against unauthorized opening, said door security apparatus comprising;

(a) a rockshaft defining a longitudinal axis;

(b) means for mounting said rockshaft on the inwardly facing surface of the door so as to be proximate and in substantially parallel relationship with the bottom edge of the door and for journalling said rockshaft for pivotable movement about its longitudinal axis;

(c) at least one stop arm extending from said rockshaft in a plane normal to the longitudinal axis thereof, said stop arm being pivotably movable with said rockshaft between an active position wherein said stop arm extends angularly and downwardly from said rockshaft in door bracing engagement with the floor in the vicinity of the door and an inactive position wherein said stop arm is out of engagement with the floor; and (d) operating means coupled to said rockshaft for pivotable operation thereof to move said stop arm between the active and inactive positions thereof, wherein said operating means comprises:

a lever fixed in a transverse position on one end of said rockshaft and having an extending end;

a pull rod having one end connected to the extending end of said lever and having a handle means on its opposite end; and bracket means for mounting on the inwardly facing surface of the door in a position elevated relative to the bottom edge of the door, said bracket means defining a bore through which said pull rod loosely extends for supporting said pull rod in an upstanding position and permitting said pull rod to be moved between an upwardly disposed position wherein said rockshaft is pivotably moved to bring said stop arm to its inactive position and a downwardly disposed position wherein said rockshaft is pivotably moved to bring said stop arm to its active positon, said security apparatus further comprising;

said lever having an aperture formed through the extending end thereof;

a lug extending normally from the one end of said pull rod and passing loosely through the aperture of said lever;

said bracket means associated with said bearing member which defines the bore of said bracket means; and latching means associated with said bearing means of said bracket means and with said pull rod by which said pull rod is selectively and releasably held in the upwardly disposed position thereof, wherein said latching means comprises:

said bearing means defining a longitudinal slot which is closed at the upper end of said bearing means and a blind latching slot which is normal with respect to the longitudinal slot and is in open communication with the longitudinal slot; and an arm extending laterally from said pull rod and disposed for up and down movement in the longitudinal slot defined by said bearing means when said pull rod is moved between its upwardly and downwardly disposed positions and is movable into the latching slot defined by said bearing means when said pull rod is moved to its upwardly disposed position and is rotated in the bore defined by said bearing means.

2. A door security apparatus for attachment to the inwardly facing surface of an inwardly opening door for bracing the door against unauthorized opening, said door security apparatus comprising:

(a) a rockshaft defining a longitudinal axis;

(b) means for mounting said rockshaft on the inwardly facing surface of the door so as to be proximate and in substantially parallel relationship with the bottom edge of the door and for journalling said rockshaft for pivotable movement about its longitudinal axis;

(c) at least one stop arm extending from said rockshaft in a plane normal to the longitudinal axis thereof, said stop arm being pivotably movable with said rockshaft between an active position wherein said stop arm extends angularly and downwardly from said rockshaft in door bracing engagement with the floor in the vicinity of the door and an inactive position wherein said stop arm is out of engagement with the floor; and (d) operating means coupled to said rockshaft for pivotable operation thereof to move said stop arm between the active and inactive positions thereof, wherein said operating means comprises;

a lever fixed in a transverse position on one end of said rockshaft and having an extending end;

a pull rod having one end connected to the extending end of said lever and having a handle means on its opposite end; and bracket means for mounting on the inwardly facing surface of the door in a position elevated relative to the bottom edge of the door, said bracket means defining a bore through which said pull rod loosely extends for supporting said pull rod in an upstanding position and permitting said pull rod to be moved between an upwardly disposed position wherein said rockshaft is pivotably moved to bring said stop arm to its inactive position and a downwardly disposed position wherein said rockshaft is pivotably moved to bring said stop arm to its active position, wherein said bracket further comprises:

a base for mounting on the inwardly facing surface of the door;

a bearing member which defines the bore of said bracket means; and means for pivotably interconnecting said base and said bearing member.

3. A door security apparatus for attachment to the inwardly facing surface of an inwardly opening door for bracing the door against unauthorized opening, said door security apparatus comprising:

(a) a rockshaft defining a longitudinal axis;

(b) means for mounting said rockshaft on the inwardly facing surface of the door so as to be proximate and in substantially parallel relationship with the bottom edge of the door and for journalling said rockshaft for pivotable movement about its longitudinal axis;

(c) at least one stop arm extending from said rockshaft in a plane normal to the longitudinal axis thereof, said stop arm being pivotably movable with said rockshaft between an active position wherein said stop arm extends angularly and downardly from said rockshaft in door bracing engagement with the floor in the vicinity of the door and an inactive position wherein said stop arm is out of engagement with the floor; and (d) operating means coupled to said rockshaft for pivotable operation thereof to move said stop arm between the active and inactive positions thereof, wherein said operating means comprises:

a lever fixed in a transverse position on one end of said rockshaft and having an extending end;

a pull rod having one end connected to the extending end of said lever and having a handle means on its other end; and bracket means mounted on the inwardly facing surface of said door proximate the door knob thereof, said bracket means defining a bore through which said pull rod loosely extends for supporting said pull rod in an upstanding position and allowing said pull rod to be moved between an upwardly disposed position wherein said stop arm is in its inactive position and downwardly disposed position wherein said stop arm is in its active position, said security apparatus further comprising;

said lever having an aperture formed through the extending end thereof;

a lug extending normally from the one end of said pull rod and passing loosely through the aperture of said lever;

said bracket means associated with said bearing member which defines the bore of said bracket means; and latching means associated with said bearing means of said bracket means and with said pull rod by which said pull rod is selectively and releasably held in the upwardly disposed position thereof, wherein said latching means comprises:

said bearing means defining a longitudinal slot which is closed at the upper end of said bearing means and which is normal with respect to the longitudinal slot a blind latching slot and is in open communication with the longitudinal slot; and an arm extending laterally from said pull rod and disposed for up and down movement in the longitudinal slot defined by said bearing means when said pull rod is moved between its upwardly and downwardly disposed positions and is movable into the latching slot defined by said bearing means when said pull rod is moved to its upwardly disposed position and is rotated in the bore defined by said bearing means.

4. A door security apparatus for attachment to the inwardly facing surface of an inwardly opening door for bracing the door against unauthorized opening, said door security apparatus comprising:

(a) a rockshaft defining a longitudinal axis;

(b) means for mounting said rockshaft on the inwardly facing surface of the door so as to be proximate and in substantially parallel relationship with the bottom edge of the door and for journalling said rockshaft for pivotable movement about its longitudinal axis;

(c) at least one stop arm extending from said rockshaft in a plane normal to the longitudinal axis thereof, said stop arm being pivotably movable with said rockshaft between an active position wherein said stop arm extends angularly and downwardly from said rockshaft in door bracing engagement with the floor in the vicinity of the door and an inactive position wherein said stop arm is out of engagement with the floor; and (d) operating means coupled to said rockshaft for pivotable operation thereof to move said stop arm between the active and inactive positions therof, wherein said operating means comprises:

a lever fixed in a transverse position on one end of said rockshaft and having an extending end;

a pull rod having one end connected to the extending end of said lever and having a handle means on its other end; and bracket means mounted on the inwardly facing surface of said door proximate the door knob thereof, said bracket means defining a bore through which said pull rod loosely extends for supporting said pull rod in an upstanding position and allowing said pull rod to be moved between an upwardly disposed position wherein said stop arm is in its inative position and downwardly disposed position wherein said stop arm is in its active position, wherein said bracket means comprises:

a base mounted on the inwardly facing surface of said door;

a bearing member which defines the bore of said bracket means; and means for pivotably interconnecting said base and said bearing member.

* * * * *